United States Patent [19]

White et al.

[11] 3,991,542

[45] Nov. 16, 1976

[54] APPARATUS FOR BANDING A STACK OF ARTICLES

[75] Inventors: Neil S. White; George R. Schindler, both of Rochester, N.Y.

[73] Assignee: Eastman Kodak Company, Rochester, N.Y.

[22] Filed: Sept. 17, 1974

[21] Appl. No.: 506,925

[52] U.S. Cl. ..... 53/198 R; 53/228
[51] Int. Cl.[2] ..... B65B 13/20; B65B 13/32
[58] Field of Search ..... 53/198 R, 228, 222

[56] References Cited

UNITED STATES PATENTS

| | | | |
|---|---|---|---|
| 2,975,571 | 3/1961 | Aronson et al. | 53/198 R |
| 3,251,171 | 5/1966 | Lagesse | 53/228 X |
| 3,343,334 | 9/1967 | Bode et al. | 53/198 R X |
| 3,577,702 | 5/1971 | Bescript | 53/198 R |

*Primary Examiner*—Leon Gilden
*Attorney, Agent, or Firm*—S. W. Gremban

[57] ABSTRACT

A banding apparatus with a ball-type, reciprocally movable web gripping mechanism cooperable with a web transfer mechanism for gripping one end of a web. The web gripping mechanism extends the web across the open end of a banding chute. A stack handling member is mounted for reciprocal movement in the chute between a normal upper position and a lower position. When the member is moved to its lower position, it acts as a support for the stack and a guide for the web. When the member is moved to its upper position, it elevates a completed bundle into position for transfer from the banding apparatus. With regard to the method steps involved to form a completed bundle, a stack of articles is moved into engagement with the web and support member, and then inserted into the banding chute through the open end thereof for moving the member to its lower position. The member is provided with guides which during downward movement of the member extend upwardly for guiding the web around the stack of articles. After the stack is fully inserted into the chute, the web gripping mechanism releases the end of the web and folds it partially over the top surface of the stack. A heating arm moves a portion of the web extending between the stack and the web transfer mechanism to a position overlapping the web end for sealing the two together. A web cut-off knife cuts the web from the web transfer mechanism providing a web flap which is blown by an air jet to the opposite side of the seal.

12 Claims, 13 Drawing Figures

APPARATUS FOR BANDING A STACK OF ARTICLES

BACKGROUND OF THE INVENTION

1. Field of the Invention

This invention relates generally to the packaging art, and more specifically to a method and apparatus for banding a stack of articles into a bundle.

2. Description of the Prior Art

It is generally well known in the art to provide bag-bundling machines containing bag-bundling apparatus for wrapping a band around a stack of bags to form a bundle. Exemplary patents disclosing such apparatus are U.S. Pat. Nos. 3,343,334; 3,550,349 and 3,619,976. Although the disclosed bag-banding apparatus operates satisfactorily, the need still exists for a high speed banding apparatus for banding a stack of small articles such as dental packets into bundles. One problem or disadvantage of the prior art bag-banding apparatus is that movement of the banding web may occur during the banding operation resulting in improper positioning of the web ends at the sealing station and a defective seal. Another disadvantage is that the prior art apparatus is designed to bundle a stack of a set height, and cannot be readily modified to bundle stacks of varying height. Another disadvantage of one or more of the prior art banding apparatus is the necessity of precisely locating the ends of the banding web prior to the banding operation, and the subsequent mutilation of the web ends prior to positioning the web in overlapped relation for sealing. The mutilated web ends when sealed result in an untidy seal and a resulting untidy bundle.

SUMMARY OF THE INVENTION

In accordance with a preferred embodiment of this invention, a banding apparatus is disclosed for banding or wrapping a band around a stack of articles such as dental packets to form a bundle. The banding apparatus comprises a banding chute having an entry opening, a web transfer mechanism on one side of the entry opening, and web gripping means in a normal position on the other side of the entry opening. When operated, the web gripping means is moved from its normal position across the entry opening for gripping one end of the banding web releasably held by the web transfer mechanism, and then moved back to its normal position for extending the banding web across the entry opening. A mechanism is provided for inserting a stack of articles into the banding chute causing the web to unwind from a web supply feeding the web transfer mechanism, and to wrap around two sides and lower end of the stack. The web gripping means releases the web end and folds it across the fourth or upper end of the stack. A sealing means is provided for engaging a portion of the web between the web transfer mechanism and the stack and folding the web portion into overlapping engagement with the web end for sealing the two together. A severing means is provided for severing the web portion from the web transfer mechanism. A fluid jet is provided on the web transfer mechanism for blowing the severed web portion toward the other side of the seal.

More specifically, in this embodiment of the invention the web gripping means comprises a gripping head having a slot for receiving one end of the web, a ball on one side of the slot, a friction member on the other side of the slot, and means such as fluid under pressure for forcing the ball into gripping engagement with the web end. The web transfer mechanism comprises a slider member movable between normal and retracted positions. The slider member further has a passageway extending therethrough for receiving the web, and means for holding the web in the passageway with leading ends of the web and slider member in register. The slot in the gripping head and the passageway in the slide member are substantially in alignment. Accordingly, movement of the gripping head to its extended position causes the head to engage and move the slider member to its retracted position. Since the web is prevented from moving by the web holding means, the web end enters the slot. The web holding means comprises a tubular post having one end adjacent the web, and the other end connected to a source of vacuum. The vacuum is applied to the post causing the one end to hold the web during movement of the slider member from its normal position to its retracted position. The banding apparatus is further provided with a stack handling means comprising a member reciprocally movable between upper and lower positions. The member acts as a support for the stack and guides the web around the stack during movement of the member to its lower position. The member elevates a completed bundle of articles from the chute to a transfer position when moved to its upper position. The member comprises a housing, a rod, and a spring interposed between the housing and rod. The member further has spaced guide plates secured to the rod and movable relative to the housing. In a normal position of the housing, end surfaces of the plates normally extend above knife edges on upper ends of the guide plates in position to be engaged by the stack inserted into the chute. Downward movement of the stack by any suitable fluid cylinder causes the housing to move relative to the guide plates for moving the stack into engagement with the knife edges of the guide plates. Accordingly, the knife edges guide the web around the stack during downward movement of the stack into the chute.

The chute is further provided with a vacuum box for releasably holding the web while the web end is released and folded over the upper end of the stack, and while the web portion is engaged by the arm of a web heating means and folded over the web end. The chute has a first sensing means and the vacuum box a second sensing means. The vacuum box is slidably mounted on the chute and has a normal position in which the first and second sensing means, when activated, cooperate to provide a signal indicating a poor splice. When the completed bundle is elevated, the vacuum box adheres to and is moved upwardly with the bundle to a test position in which the first and second sensing means cooperate to provide a signal indicating a good splice.

Accordingly, one of the objects and advantages of this invention is to provide a banding apparatus capable of banding stacks of small articles such as dental packets into bundles at a high rate of speed.

Another object and advantage of the invention is to provide an improved banding apparatus that prevents web slippage during the banding operation.

Another object and advantage of the invention is to provide a banding apparatus that is capable of banding a stack of articles of any reasonable length or height without undue modification.

Another object and advantage of the invention is to provide a banding apparatus that is of simple design and construction, thoroughly reliable and efficient in operation, capable of achieving good reproducible seals and completed bundles, and economical to manufacture.

The invention and its objects and advantages will become more apparent from the detailed description of the preferred embodiment presented below:

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
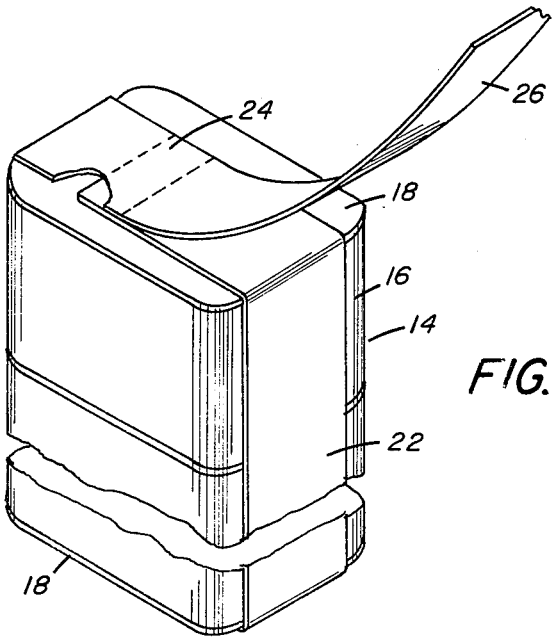
FIG. 1 is a perspective view of a completed bundle or stack of articles.

With reference to FIG. 1 of the drawing, a banded stack or bundle 14 of flat articles 16 is disclosed comprising a plurality of stacked packets such as dental X-ray packets having an end board 18 at each end and, if desired, a printed reorder or information board 20 interposed therebetween. A bnding web 22 of any suitable material such as Mylar (trademark) is wrapped around the stack of packets 16, and overlapped ends thereof are sealed together along a seal 24 to combine the loose packets into a single bundle. The bundle 14 has an extending flap 26 which is useful in tearing open the seal 24 and removing the web 22 after the bundle is inserted into a dispenser, not shown.

The banding apparatus of this invention is useful in any type of banding operation where articles 16 are bundled, and particularly useful in a dental X-ray packet bundling machine. In such a machine, several webs of different raw materials are combined to form a finished web containing spaced apart dental packets surrounded by a sealed area. The web is fed intermittently to a punching station where the packets are severed from the web. The severed packets are collected into stacks, and the stacks transferred into peripherally-spaced pockets in a carousel tray. The tray is intermittently rotated causing the packets to move through a board inserting station where end boards and printed reorder boards are inserted underneath and on top of selected stacks. The stacks are combined in propr order into a larger stack which is then advanced to a banding station where the banding apparatus of this invention is located.

Figure 2:
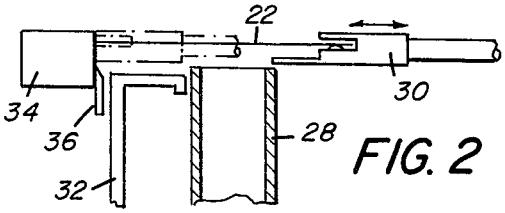
FIG. 2 is a segmental side elevational view of the banding apparatus with a banding web extending across the entry opening of the banding chute.
Figure 5:
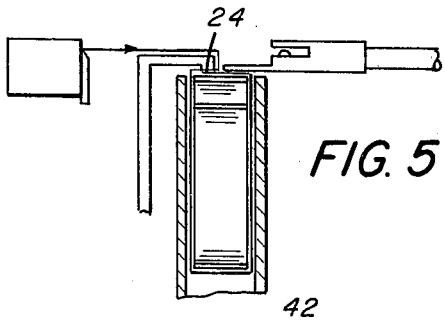
FIG. 5 is a view similar to FIGS. 2–4 in which a sealing arm engages the web portion between the stack and web transfer mechanism, folds the web portion over the web end and seals the two together.
Figure 6:
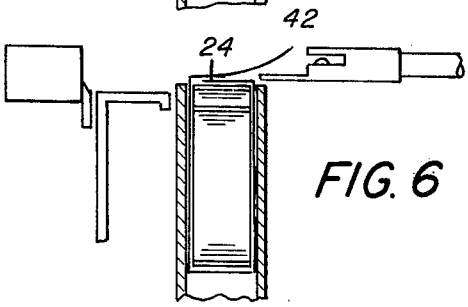
FIG. 6 is a view similar to FIGS. 2–5 in which the web portion is severed, the web flap moved to the opposite side of the seal, and the web gripping mechanism and sealing arm returned to their normal position.
Figure 4:
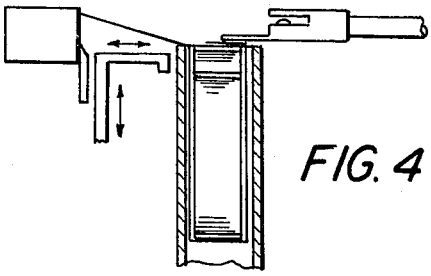
FIG. 4 is a view similar to FIGS. 2 and 3 in which the web end is released and folded over the upper end of the stack.
Figure 7:
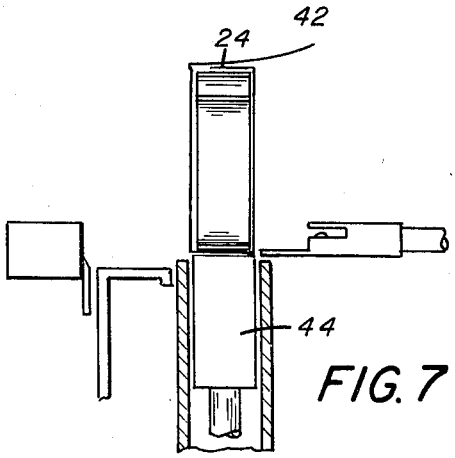
FIG. 7 is a view similar to FIGS. 2–6 in which the completed bundle is elevated to a position for removal from the banding apparatus.

With reference to FIGS. 2–7, the apparatus for banding a stack of dental packets 16 such as disclosed in FIG. 1 generally comprises a banding chute 28, a web gripping mechanism 30, a sealing arm 32, a web transfer mechanism 34 and a web cut-off knife 36. The method or sequence of operation in banding a stack of articles 16 such as dental packets to form a complete bundle 14 is as follows. Initially, the web gripping mechanism 30, sealing arm 32, web transfer mechanism 34 and web cut-off knife 36 are in their normal positions as shown in FIG. 2. The web gripping mechanism 30 is moved by any suitable fluid cylinder or the like from its normal position to an extended position (shown dotted in FIG. 2) in which it grips the leading end of banding web 22 and then is returned to its normal position extending the web across the open mouth of banding chute 28. A stack of loose articles 16 is inserted into banding chute 28 (FIG. 3) by any suitable stack inserting means such as a fluid cylinder 40 causing the banding web 22 from a web supply, not shown, to pass through web transfer mechanism 34 and encircle two sides and lower end of the stack of articles 16. The web gripping mechanism 30 then releases the leading end of web 22 (FIG. 4) and moves inwardly a short distance to fold the leading end of the web over the upper end of the stack. The sealing arm 32 is then moved upwardly into engagement with a portion 42 of the web between the stack and web transfer mechanism 34, and then toward the web gripping mechanism 30 for overlapping the portion of the web over the leading end and sealing the two together (FIG. 5) to form seal 24. The web portion 42 is severed by web cut-off knife 36 and blown to the opposite side of seal 24 to minimize the likelihood of seal breakage when the bundle 14 is lifted from chute 28 and the web gripping mechanism 30 and sealing arm 32 are returned to their normal positions (FIG. 6). The banded stack or bundle 14 of packets is then lifted out of banding chute 28 (FIG. 7) by a stack handling means 44 to be described hereinafter. The stack inserting means 40, web gripping mechanism 30, sealing arm 32, cut-off knife 36 and stack handling means 44 are operated in timed relation by any suitable control mechanisms such as air valves, cylinders and cams.

Figure 8:
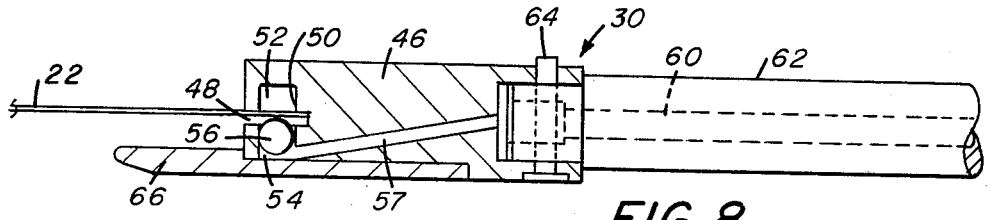
FIG. 8 is a segmental view in section of the web gripping mechanism.

With reference to FIG. 8, a head 46 of web gripping mechanism 30 is disclosed in greater detail. The head 46 defines a slot 48 for receiving the leading end of banding web 22, a groove 50 on one side of slot 48 for holding a pad of friction material 52 of urethane or the like, and a groove 54 on the other side of slot 48 for loosely holding one or more steel balls 56. The slot 54 is connected by a passageway 57 to a sealed enclosure 58 which is connected to a central opening 60 in a cylinder arm 62 coupled to head 46 by a pin 64. Any suitable seal is provided between head 46 and arm 62 to prevent fluid leakage. The opening 60 in arm 62 is connected to any suitable source of fluid pressure such as air pressure by any suitable valving. With no air pressure provided, the ball 56 falls by gravity to the lowermost position in groove 54 where it is retracted out of slot 48. When the air pressure is valved to opening 60 and passageway 57, the ball 56 is forced upwardly into engagement with friction pad 52 for gripping the end of web 38 interposed therebetween. The lower end of groove 54 is closed off by a web folding arm 66 which is secured to head 46 in sealed relation by any suitable means.

Figure 9:
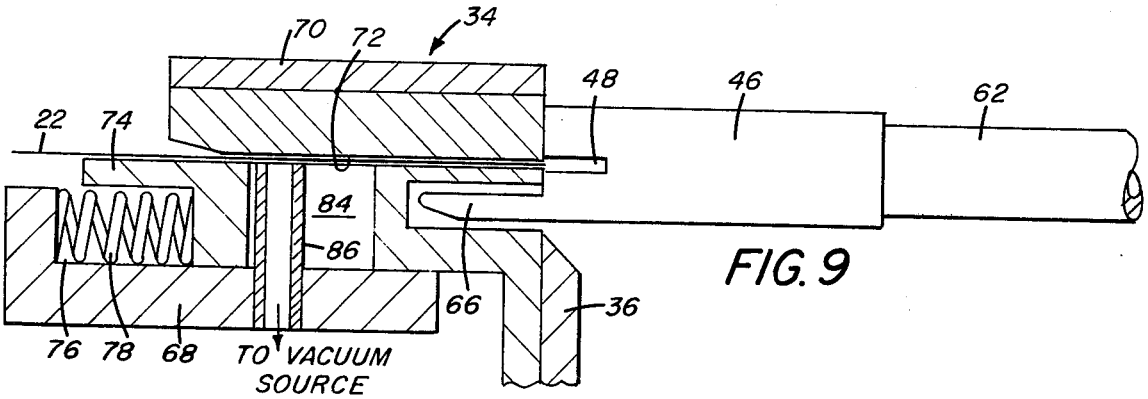
FIG. 9 is a segmental side elevational view partially in section illustrating the web gripping mechanism in engagement with the web transfer mechanism which is in its extended position.
Figure 9A:
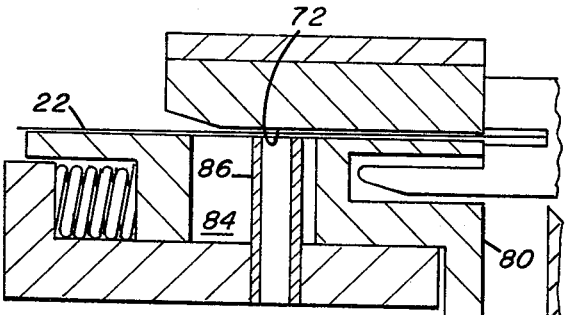
FIG. 9A is a segmental view similar to FIG. 9 showing the web transfer mechanism in its retracted position, and the web end in position to be gripped by the web gripping mechanism.

With reference to FIGS. 9 and 9A, the web transfer mechanism 34 and cut-off knife 36 are disclosed in greater detail. The web transfer mechanism 34 comprises a stationary housing 68 and a movable slider member 70 having a surface slidably movable on an upper surface of housing 68. The slider member 70 has a passageway 72 extending therethrough through which banding web 22 is fed on demand from any suitable supply roll and looper by any suitable web drive means such as drive rollers or the like none of which are shown. The slider member 70 has a flange 74 which cooperates with housing 68 to form an enclosure 76 for a spring 78 for biasing the slider member 70 to an extended position as seen in FIG. 9 causing an end cutting surface 80 to be moved into engagement with a cutting surface 82 of reciprocally movable cut-off knife 36. The slider member 70 is further provided with an elongated slot 84 into which extends a hollow or tubular vacuum post 86 which is secured to housing 68. AN open end of post 86 is adjacent passageway 72, and the other end of the post is connected to any suitable vacuum source. To transfer the leading end of banding web 22 to web gripping mechanism 30, the gripping mechanism is initially moved to the position illustrated in FIG. 9 with slot 48 thereof in register or alignment with passageway 72, and the vacuum source is connected to post 86 for holding the banding web in a stationary position. The web gripping mechanism 30 is then moved inwardly to the position illustrated in FIG. 9A causing the end of the fixed or held web 22 to enter slot 48 in the web gripping mechanism. Air pressure is then ported to gripping head 46 causing ball 56 to grip the web end, and the vacuum is disconnected to post 86. The web gripping mechanism 30 can then be returned to its normal position extending web 22 across the open end of banding chute 28 as illustrated in FIG. 2. During such movement, spring 78 returns slider member 70 to its normal position as illustrated in FIG. 9.

Figure 10:
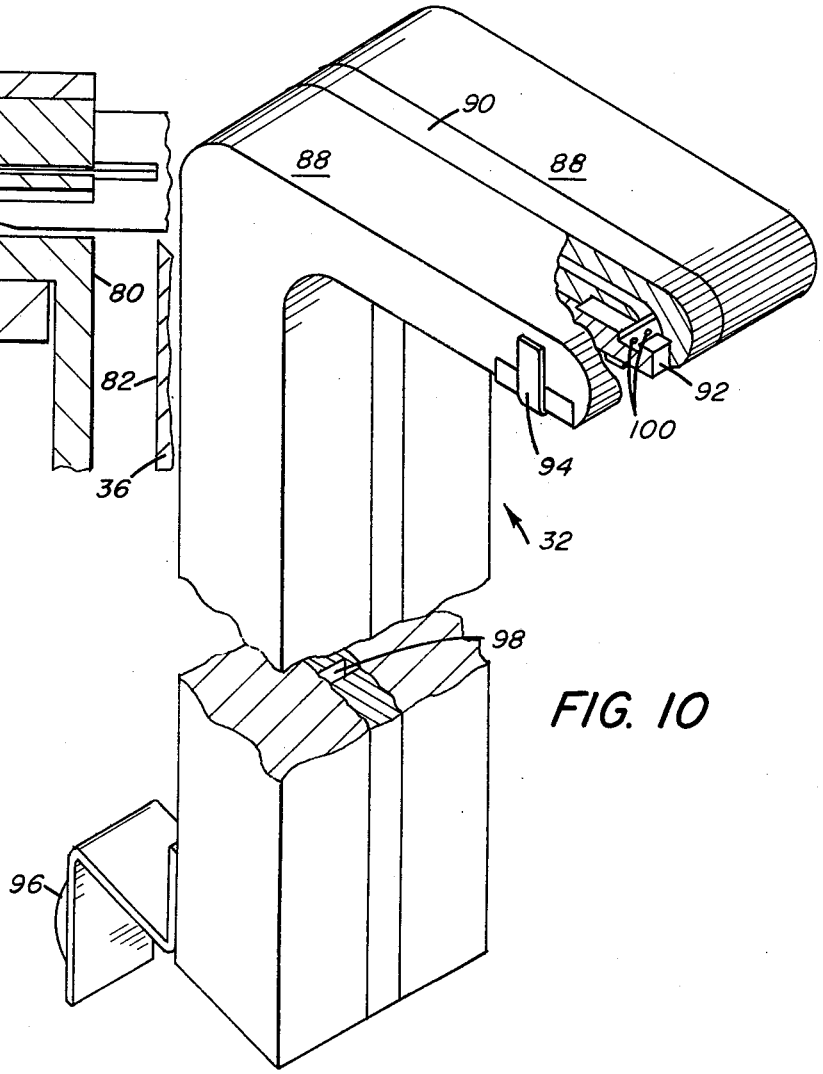
FIG. 10 is a perspective view of the sealing arm with portions thereof broken away to better illustrate some of the parts thereof.

With reference to FIG. 10, heater arm 32 is disclosed in greater detail. The heater arm 32 comprises a pair of inverted L-shaped metallic members 88 on opposite sides of a similar shaped insulator 90, all secured together as a unit by any suitable means. One end of the arm 32 is provided with a groove for receiving an electrically non-conductive ceramic pad 92 or the like over which a heater wire 94 of nichrome or the like is mounted. The heater wire 94 is connected to metallic members 88 which in turn are connected by electrical contacts 96, only one of which is shown, to energized or power-connected stationary contacts, not shown, when heater arm 32 is moved to its sealing position for sealing the overlapping web portions together. When arm 32 is retracted, electrical contacts 96 are disconnected from the power contacts and the wire cools. A continuous supply of pressurized air is supplied through a flexible hose through an air channel 98 in insulator 90 and through openings 100 in support pad 92 against heater wire 94 for cooling the wire. The air flow is directed against heater wire 94 even during the sealing operation, and hence as arm 32 is withdrawn, this air flow aids in setting the seal. Since heater wire 94 is cooled between each sealing operation, the need for a thermostat is eliminated. The amount of heat supplied to heater wire 94 is a function of the amount of current supplied, and this can be controlled by a timer, not shown. The duration of time the current is supplied to heater wire 94 can also be controlled by the make and break of the electrical contacts 96, thereby eliminating the need for a timer.

Figure 3:
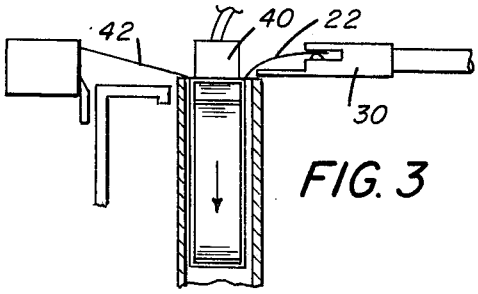
FIG. 3 is a view similar to FIG. 2 in which a stack of articles has been inserted into the chute.
Figure 11:
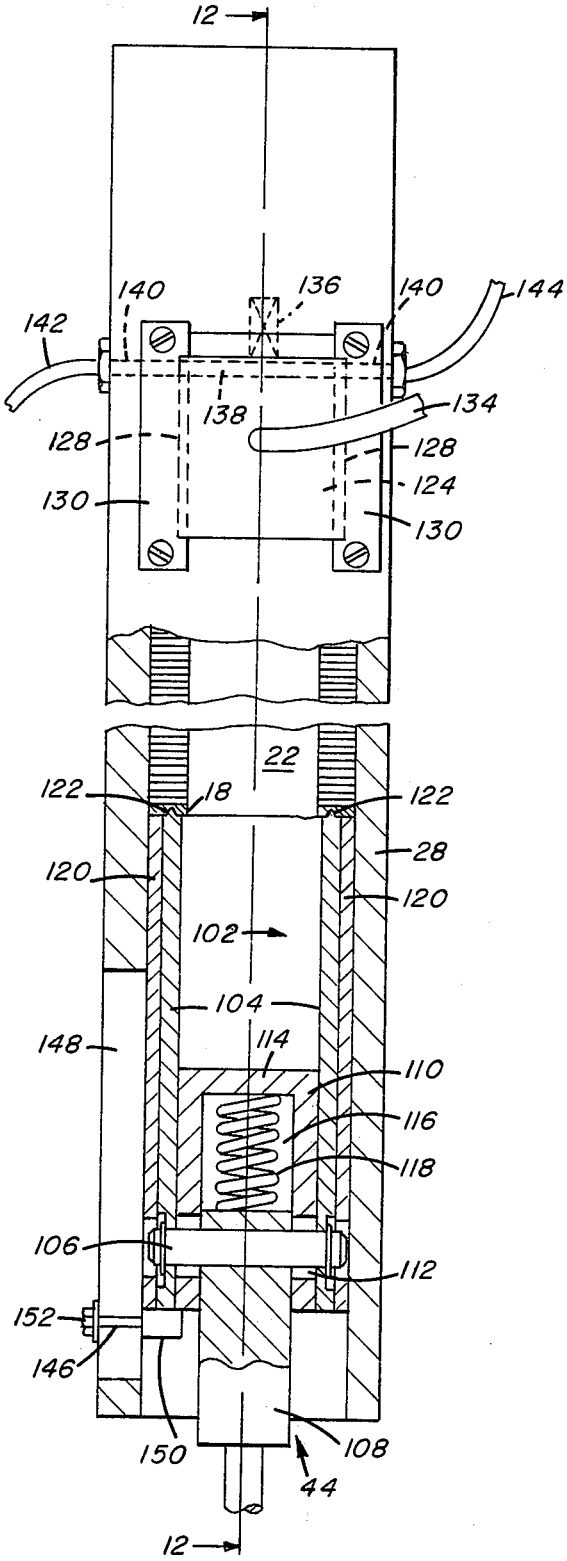
FIG. 11 is a front elevational view partially in section of the banding chute and stack handling member in its lower position.
Figure 12:
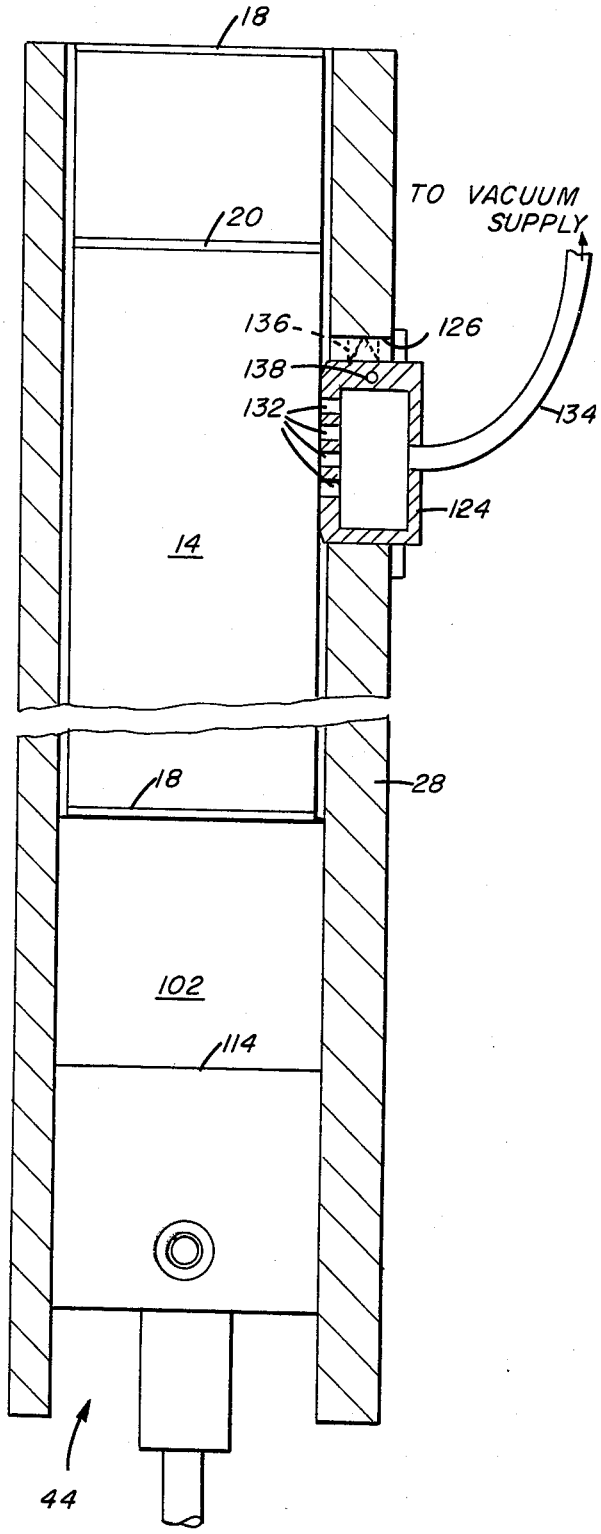
FIG. 12 is a section view taken substantially along line 12—12 of the banding chute of FIG. 11.

With reference to FIGS. 11 and 12, banding chute 28 and stack handling means 44 is disclosed in greater detail. The chute 28 is provided with an opening extending therethrough of substantially the same rectangular configuration as the shape of the article to be banded. Since chute 28 was designed to band dental X-ray packets, the opening is of a substantially rectangular cross-section slightly larger than the outer periphery of the dental packet to prevent binding. The stack handling means 44 comprises a member 102 reciprocally movable within chute 28 by any suitable fluid or air cylinder between an upper position (FIG. 7) and a lower position (FIG. 3). In the upper position, the upper surface of member 102 extends slightly above the upper surface of the chute to provide a surface over which a completed bundle 14 of articles may be slid onto a conveyor or the like for removing the bundle of articles from the banding apparatus. In the lower position, the upper surface of the stack of articles is slightly above the upper level of chute 28 to provide a surface on which the overlapped web ends can be sealed. The member 102 comprises guide plates 104 secured by a pin 106 to one end of a cylinder rod 108. The member 102 further comprises a housing 110 slidably movable relative to guide plates 104 by virtue of an enlarged opening 112 in the housing through which pin 106 extends. The housing 110 has a cup-shaped portion 114 cooperating with the upper end of cylinder rod 108 to form a cavity 116 into which a spring 118 is interposed for biasing guide plates 104 and housing 110 apart from one another. With member of the stack handling means 44 in its upper position (FIG. 7), spring 118 urges housing 110 upwardly relative to guide plates 104 causing the upper surface of side plate 120 of the housing, which are preferably integral therewith, to extend above knife edges 122 of guide plates 104. Accordingly, a completed bundle 14 elevated by member 102 can be slid along the upper edges of side plates 120 and onto any suitable conveyor or the like. After a banding web 22 has been pulled across the entry opening of chute 28 as illustrated in FIG. 2, a stack inserting cylinder 40 is operated for inserting into chute 28 a new stack of articles to be banded. The lower end board 18 of the stack engages the upper ends of side plate 120 and moves the side plates and housing 110 downwardly depressing spring 118 against rod 108 and a fluid cylinder, not shown, coupled thereto for holding rod 108 in its upper position (FIG. 7) causing the knife edges 122 of guide plates 104 to partially penetrate into end board 18, as best illustrated in FIG. 11, providing guides for web 22 as the stack is lowered into the chute. The upper and lower fluid cylinders are arranged so that the upper cylinder can overcome the lower cylinder and force the stack of articles downwardly to its lower position illustrated in FIG. 3.

The chute 28 is further provided with a slidably mounted vacuum box 124 for the purpose of gripping banding web 22 and preventing sliding movement thereof during the banding operation, and also to check for seal quality. The vacuum box 124 extends through an opening 126 in the side of chute 28 and is mounted thereon for slidable movement by any suitable means such as ribs 128 on the box slidably movable within guide rails 130 secured to the side wall of chute 28. The wall of box 124 adjacent banding web 22 on the stack is provided with perforations 132, and the opposite wall has an opening connected by a flexible hose 134 to a suitable vacuum supply. A spring 136 is interposed between the chute wall and vacuum box 124 for biasing the box to its lowermost position into engagement with the lower wall of the opening as illustrated in FIG. 12. During the banding operation, the vacuum is ported to box 124 causing the banding web 22 to adhere to the box with a set force and to be restrained from movement in either direction as long as the moving force does not exceed the set force or the weight of the box. Such web movement may otherwise occur after the web gripping mechanism 30 has released the web end or when heater arm 32 is moved to the sealing position drawing additional web through the web transfer mechanism 34. The vacuum box 124 in its normal position is further provided with an air passageway 138 which is aligned with openings 140 in the chute wall as best illustrated in FIG. 11. One opening is connected by any suitable hose 142 to an air supply and the other opening 144 to any suitable sensor. When a successfully sealed bundle 14 of articles is raised, the upward force exceeds the force of spring 136 and the weight of vacuum box 124 causing the box to be pulled upwardly along with the web breaking the connection between air supply hose 142 and sensor hose 144 and resulting in the indication of a good seal by an annunciator or the like. If an unsuccessfully sealed bundle 14 is raised, the seal 24 will break due to the additional drag on the web by the spring force and weight of vacuum box 124. Accordingly, the box will not be raised, and air supply through hose 142 is directed to the sensor through hose 144 indicating a poor seal. A poorly sealed web 22 is removed, and the stack goes through another banding cycle of operation.

The banding apparatus is readily adaptable to band a stack of any height merely by using an adjustable stop mechanism to limit downward travel of member 102. One form of stop is illustrated in FIG. 11 as a stop lug 146 slidably movable within a slot 148 in a side wall of the chute. The lug 146 has a head 150 at one end engageable by the lower end of member 102, and a nut 152 at the other end for securing the stop lug 146 in a selected position depending upon the length of the stack to be banded.

The invention has been described in detail with particular reference to a preferred embodiment, but it will be understood that variations and modifications can be effected within the spirit and scope of the invention as described.

We claim:

1. In an apparatus for banding a stack of articles to form a bundle, the combination comprising:

a banding chute having an entry opening;

means including a web transfer mechanism on one side of said entry opening;

web gripping means on the other side of said entry opening in an initial position, said web gripping means being movable from its initial position across said entry opening to an extended position for gripping one end of a web held by said web transfer mechanism, and then movable back to its initial position for extending said web across said entry opening;

means for inserting a stack of articles into said banding chute causing said web to advance from said web transfer mechanism and to wrap around two sides and lower end of said stack;

said web gripping means releasing said one end of said web at said initial position and movable to a folding position for folding said one end across an upper end of said stack;

sealing means on said one side of said entry opening separate from said web gripping means for engaging a continuous portion of said web between said web transfer mechanism and said banding chute, folding said web portion over and into engagement with said one end of said web and sealing said web portion to said one end to form a bundle of articles; and means for severing said sealed web portion from said web transfer mechanism.

2. The invention according to claim 1 wherein said web gripping means comprises a head having a slot for receiving said one end of said web, a ball on one side of said slot, and means for forcing said ball into gripping engagement with said one end of said web.

3. The invention according to claim 2 wherein said forcing means comprises a source of fluid pressure.

4. The invention according to claim 2 wherein said web transfer mechanism comprises a slider member movable between normal and retracted positions, a passageway extending through said slider member for receiving said web, means for holding said web in said passageway; and means for moving said head of said web gripping means into engagement with said slider member with said slot and said passageway in alignment, further movement of said head causing said slider to move to its retracted position and said one end of said web held by said holding means to enter said slot.

5. The invention according to claim 4 wherein said web holding means comprises a tubular post having one end adjacent said web, and a source of vacuum connected to the opposite end of said post during movement of said slider member from its normal position to its retracted position.

6. The invention according to claim 1, and further comprising a fluid jet on said one side of said entry opening for blowing said severed web portion to the opposite side of said seal.

7. The invention according to claim 1, and further comprising stack handling means for elevating said bundle of articles from said chute.

8. The invention according to claim 7 wherein said stack handling means comprises a housing reciprocally movable within said chute, a rod, a slot in one of said rod and housing, a pin on the other of said rod and housing insertable through said slot for loosely securing said rod to said housing, and a spring interposed between said housing and said rod for biasing said housing and said rod apart from one another.

9. The invention according to claim 8 wherein said stack handling means further comprises spaced guide plates secured to said rod, said housing having side plates with ends thereof normally extending above the ends of said guide plates and being engageable by said lower end of a stack inserted into said chute by said stack inserting means, said stack inserting means moving said ends of said side plates relative to said ends of said guide plates causing said ends of said guide plates to be engaged by said lower end of said stack whereby said ends of said guide plates guide said web around said stack upon downward movement of said stack.

10. The invention according to claim 9 wherein said ends of said guide plates are knife-edged.

11. The invention according to claim 1, and further comprising a vacuum box supported by said chute for releasably holding said web adjacent said one end of said web as said one end is released and folded and said web portion is engaged and folded over said one end of said tape.

12. The invention according to claim 11 wherein said chute has a first portion of a sensing means, and said vacuum box is slidably mounted on said chute and has a second portion of said sensing means which normally assumes one position relative to said first portion, said box being moved by said web as a properly banded bundle is elevated by said web handling means causing said second portion of said sensing means to assume a different position relative to said first portion whereby said sensing means responds to indicate a good splice.

* * * * *